US006138751A

United States Patent [19]

Hart

[11] Patent Number: 6,138,751

[45] Date of Patent: Oct. 31, 2000

[54] HANGER ASSEMBLY

[75] Inventor: Brian Hart, Wakefield, United Kingdom

[73] Assignee: Cooper Cameron Corporation, Houston, Tex.

[21] Appl. No.: 09/268,910

[22] Filed: Mar. 16, 1999

[30] Foreign Application Priority Data

Apr. 14, 1998 [EP] European Pat. Off. ..... 98302854

[51] Int. Cl.[7] ..... E21B 33/04

[52] U.S. Cl. ..... 166/75.14; 166/208; 166/217; 285/123.4; 285/123.11

[58] Field of Search ..... 166/75.14, 208, 166/215, 217; 285/123.4, 123.11

[56] References Cited

U.S. PATENT DOCUMENTS

| | | | |
|---|---|---|---|
| 3,405,763 | 10/1968 | Pitts et al. | 166/46 |
| 3,420,308 | 1/1969 | Putch | 166/208 |
| 3,424,477 | 1/1969 | Putch et al. | 285/18 |
| 3,472,530 | 10/1969 | Fowler | 285/3 |
| 3,592,489 | 7/1971 | Baugh et al. | 285/18 |
| 3,664,689 | 5/1972 | Hanes | 285/18 |
| 4,790,379 | 12/1988 | Vanderford, Jr. | 166/208 |
| 4,982,795 | 1/1991 | King | 166/382 |
| 5,301,750 | 4/1994 | Watkins | 166/208 |
| 5,330,002 | 7/1994 | Saunders | 166/208 |
| 5,638,903 | 6/1997 | Kent | 166/348 |
| 5,727,631 | 3/1998 | Baker et al. | 166/379 |

FOREIGN PATENT DOCUMENTS

| | | |
|---|---|---|
| 1 196 573 | 11/1985 | Canada . |
| 0 368 515 A1 | 5/1990 | European Pat. Off. . |
| 1 064 898 | 9/1959 | Germany . |

OTHER PUBLICATIONS

European Search Report for EP 98 30 2854, Examiner C. Tompouloglou, Sep. 25, 1998.

*Primary Examiner*—Hoang Dang
*Attorney, Agent, or Firm*—Jackie Lee Duke

[57] ABSTRACT

A hanger assembly comprising a tubular housing having an internal cylindrical bore provided with an annular recess containing a fixed, annular, downwardly tapering ramp, and, supported on the ramp, a split, radially contractible, wedge locking ring which normally adopts a relaxed position not projecting into the bore; and a tubular hanger having an external surface which is a clearance sliding fit in the bore and which is provided with resilient energising mechanism, which are recessed in the external surface and held there by engagement with the bore during running in of the hanger until the energising mechanism come into alignment with the annular recess, whereupon the energising mechanism expands radially outwards to overlie the locking ring, final running in of the hanger forcing the locking ring down the ramp and hence causing the ring to contract radially and to grip the external surface of the hanger.

4 Claims, 2 Drawing Sheets

Figure 1:
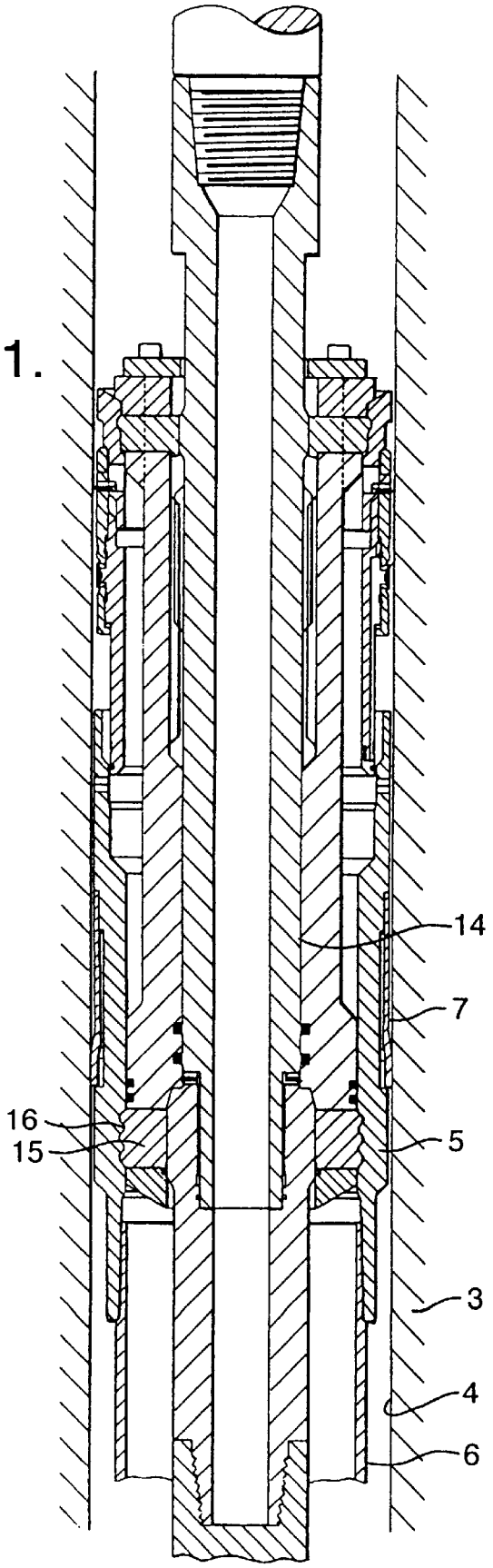

4
3
20
19
5
8
9
10
7B
5
3
8
9
7A
8A
18
17
11
12
13
10

HANGER ASSEMBLY

In the formation or operation of a well in an oil or gas field, it is commonplace to suspend a hanger for a working or production string, such as a casing string, at a wellhead. There is an increasing demand for drill-through spool trees and wellhead systems, with a slick bore, as this eliminates the requirement to reinstall the BOP stack for completion operations, thereby saving considerable rig time. However, on any drill-through system there is an inherent lack of landing shoulders to support the hangers owing to the need to maintain maximum drift within the wellhead housing to accommodate the drilling tool.

The object of the present invention is to enable the drill-through feature to be retained whilst providing a robust mechanism to support an appropriately sized hanger.

In accordance with the present invention, a hanger assembly comprises a tubular housing having an internal cylindrical bore provided with an annular recess containing a fixed, annular, downwardly tapering ramp, and, supported on the ramp, a split, radially contractible, wedge locking ring which initially adopts a position not projecting into the bore; and a tubular hanger having an external surface which is a clearance sliding fit in the bore and which is provided with resilient energising means, which are recessed in the external surface and held there by engagement with the bore during running in of the hanger until the energising means come into alignment with the annular recess, whereupon the energising means expands radially outwards to overlie the locking ring, final landing of the hanger forcing the locking ring down the ramp and hence causing the ring to contract radially and to grip the external surface of the hanger.

With this arrangement, the internal bore in the housing remains unobstructed as, prior to running in of the hanger, the annular ramp and locking ring are recessed into the wall of the bore. During landing of the hanger, the energising means expand resiliently outwards when they come into alignment with the annular recess in the bore and thereupon energise the locking ring by forcing it down the annular ramp. The locking action is thus automatically self setting under the weight of the string to be suspended.

The energising means are preferably a ring of axially extending spring fingers located in complementary grooves in the external surface of the hanger.

The annular ramp may be provided on a ring which is screwed into the annular recess of the bore.

The radially inwardly facing surface of the locking ring, which ultimately grips the external surface of the hanger, and also the complementary part of the external surface of the hanger, are preferably serrated to provide high load bearing capacity between the parts.

When the suspended string is to be pulled, it is simply necessary to pull the hanger with the conventional running tool whereupon the locking ring will be drawn up the annular ramp and expanded, preferably under its own resilience, to release the hanger.

Figure 2:
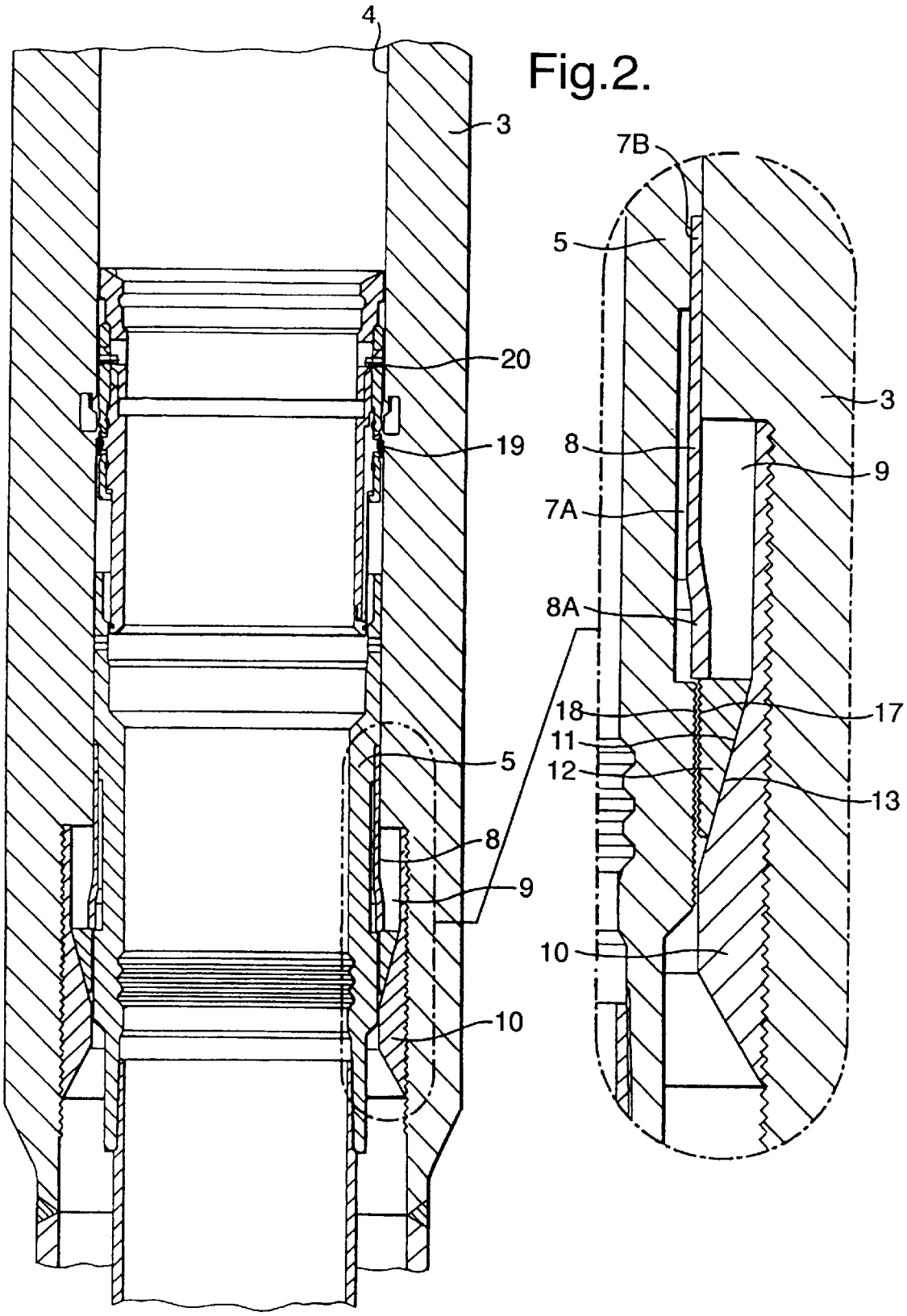

An example of a hanger assembly constructed in accordance with the present invention is illustrated in the accompanying drawings, in which:

FIG. 1 is an axial section showing a casing string being run in through a well head housing; and FIG. 2 is an axial section showing the casing string suspended in the housing after removal of the running tool.

The illustrated assembly comprises a wellhead housing 3 having a nominal 16 inch cylindrical bore 4. Associated with the housing 3 is a casing hanger 5 into the lower end of which is screwed the upper section 6 of a casing string.

As best shown in the enlarged portion of FIG. 2, the hanger 5 is provided, at each of four equalangularly spaced positions around its external surface, with an axially extending elongate stepped groove 7 providing a deeper lower portion 7A and a shallower upper portion 7B. The shallower portion 7B of each groove is substantially filled by the upper end of a respective spring finger 8 which extends the full length of the groove and the lower end 8B of which is cranked radially outwardly.

The bore of the housing 3 is also stepped and provides an annular recess 9 in a lower portion of the bore 4. Within the recess 9 is screwed a ring 10 providing a radially inwardly facing annular ramp 11. Located upon the ramp 11 is a C-shaped split resilient locking ring 12 having a radially outwardly facing wedge surface 13 which overlies the ramp surface 11 of the ring 10. In the initial position of the ring 12, it does not project into the cylindrical envelope of the bore 4. It will normally be necessary for the ring to be biased radially outwardly to prevent the ring from sliding into the bore under its own weight.

During running in of the casing string, the hanger 5 is supported by a running tool 14 via conventional radially extendable and contractible dogs 15 engaging complementary undulating surfaces 16 in the inner wall of the hanger.

As the hanger is run in on the tool 14, the lower parts 8*a* of the fingers 8 are deflected radially inwardly by engagement of the parts 8A with the wall of the bore 4 and are accommodated in the lower deeper part 7A of the grooves 7, as shown in FIG. 1.

When the lower ends 8A of the fingers 8 come into alignment with the recess 9 in the bore of the housing 3, the lower ends of the spring fingers are free to move radially outwardly to their relaxed position, in which they overlie the upper face of the locking ring 12. Further running in of the string causes the fingers 8, acting in axial compression, to force the locking ring 12 to slide down the ramp 11 and, in doing so, to contract radially so that a serrated inner peripheral surface 17 of the ring 12 grips a similarly serrated outer surface part 18 of the hanger, to secure the hanger in its landed position. The greater the weight acting downwards on the hanger, the greater will be the movement of the ring 12 and down the ramp 11 and the tighter will be the engagement between the parts 17 and 18.

Thereafter a conventional metal to metal seal 19, between the hanger 5 and the housing 3 will be energised and a conventional lockdown mechanism 20, also between the hanger 5 and housing 3, will be set.

What is claimed is:

1. A hanger assembly, comprising:

a wellhead housing having a cylindrical bore and an annular recess therein;

an inwardly facing annular ramp disposed in said annular recess of said wellhead housing;

a locking ring having an outwardly facing wedge surface, said wedge surface positioned on said inwardly facing annular ramp, said locking ring biased radially outwardly to initially adopt a position not projecting into said cylindrical bore of said wellhead housing;

a casing hanger axially moveable within said cylindrical bore of said wellhead housing, said casing hanger including a plurality of radially outwardly biased spring fingers; and, said plurality of spring fingers deflected radially inwardly by engagement with said cylindrical bore of said wellhead housing until aligned with said annular recess of said wellhead housing whereupon said plurality of spring fingers expand radially outwardly to engage said locking ring and force said locking ring axially along said wedge surface of said inwardly facing annular ramp and contract said locking ring radially inwardly and said locking ring grips the external surface of said casing hanger.

2. A hanger assembly according to claim 1 wherein:

said inwardly facing annular ramp disposed in said annular recess of said wellhead housing is formed on a removable ring positioned in said annular recess of said wellhead housing.

3. A hanger assembly according to claim 2 wherein:

said removable ring is threaded into said annular recess of said wellhead housing.

4. A hanger assembly according to claim 3 wherein:

said locking ring includes a serrated inner peripheral surface;

said casing hanger including a serrated outer surface complementary to said serrated inner peripheral surface of said locking ring; and, said locking ring serrated inner peripheral surface engaging said casing hanger serrated outer surface when said locking ring is engaged by said spring fingers and forced axially along said wedge surface of said inwardly facing annular ramp.

* * * * *